US006677810B2

(12) United States Patent
Fukui

(10) Patent No.: US 6,677,810 B2
(45) Date of Patent: Jan. 13, 2004

(54) REFERENCE VOLTAGE CIRCUIT

(75) Inventor: Atsuo Fukui, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/068,358

(22) Filed: Feb. 7, 2002

(65) Prior Publication Data

US 2002/0109542 A1 Aug. 15, 2002

(30) Foreign Application Priority Data

Feb. 15, 2001 (JP) ..... 2001-039082

(51) Int. Cl.[7] ..... G05F 1/10; G05F 3/02
(52) U.S. Cl. ..... 327/541; 323/315
(58) Field of Search ..... 327/538, 540, 327/541, 543; 323/312, 315

(56) References Cited

U.S. PATENT DOCUMENTS 5,689,178 A * 11/1997 Otake ..... 323/282
5,696,440 A * 12/1997 Harada ..... 323/315

FOREIGN PATENT DOCUMENTS

JP 07200086 A * 8/1995 ..... G05F/3/30
NL 8702011 A * 3/1989 ..... G05F/3/28

* cited by examiner

*Primary Examiner*—Terry D. Cunningham
*Assistant Examiner*—Quan Tra
(74) *Attorney, Agent, or Firm*—Adams & Wilks

(57) ABSTRACT

A high accuracy reference voltage stably operating even at a low power supply voltage is provided in a semiconductor integrated circuit. A circuit structure in which the stable reference voltage can be obtained even at the low power source voltage is adopted.

8 Claims, 2 Drawing Sheets

REFERENCE VOLTAGE CIRCUIT

BACKGROUND OF THE INVENTION

1. Field of the Invention

The present invention relates to a reference voltage circuit of a semiconductor integrated circuit.

2. Description of the Related Art

A circuit shown in FIG. 3 is known as a conventional reference voltage generating circuit. That is, the circuit includes a constant current circuit comprised of an n-channel depletion type MOS transistor 170 having its source and gate grounded, a current mirror circuit formed of p-channel enhancement type MOS transistors 150 and 151, for generating and outputting a mirrored current out of a current input from the transistor 170, and an n-channel enhancement type MOS transistor 160 having its gate and drain connected to each other, for generating a reference voltage Vref from the current output by the current mirror circuit.

In the case where the transistors 150 and 151 are the same size, a drain current ID(170) of the transistor 170 is equal to a drain current ID(160) of the transistor 160, and a gate-source voltage VGS(160) of the transistors 160 becomes the reference voltage Vref.

In order that the reference voltage Vref becomes a predetermined voltage, all the transistors must operate in a saturated state. When a minimum drain-source voltage at which the transistor 170 operates in the saturated state is made VDSAT(170) and a drain-source voltage of the transistor 150 is made VDS(150), a minimum power source voltage Vdd(min) at which the reference voltage Vref becomes the predetermined voltage is obtained by the following equation:

$$Vdd(\text{min})=VDSAT(\mathbf{170})+VDS(\mathbf{150}) \quad (1)$$

When the threshold value of the transistor 170 is made Vt(170), the minimum drain-source voltage VDSAT(170) at which the n-channel depletion type MOS transistor 170 operates in the saturated state is obtained by the following equation:

$$VDSAT(\mathbf{170})=Vt(\mathbf{170}) \quad (2)$$

Normally, since Vt(170) is approximately −0.4 V and VDS(150) is approximately 1.0 V, from the equation (1), Vdd(min) is obtained by the following equation:

$$Vdd(\text{min})=-0.4\text{ V}+1.0\text{ V}=1.4\text{ V} \quad (3)$$

In the conventional reference voltage circuit shown in FIG. 3, there has been a problem that in the case of a low power source voltage, a circuit operation becomes unstable and the predetermined reference voltage Vref can not be generated.

If an attempt is made to obtain the predetermined reference voltage Vref even at a low power source voltage, it is necessary to increase the threshold value of the n-channel depletion type MOS transistor (the absolute value is made to approach zero) or to increase the threshold value of the p-channel enhancement type MOS transistor (the absolute value is made to approach zero), however, if doing so, the operation becomes impossible at high temperatures or at low temperatures.

SUMMARY OF THE INVENTION

The present invention has been made in view of the above, and an object of the present invention is therefore to enable an operation at a low power source voltage by changing a circuit structure.

In order to solve the problem, according to the present invention, a structure of a circuit is devised such that a predetermined reference voltage Vref can be obtained even at a power source voltage lower than a conventional one.

By adopting such a structure, it is possible to provide a high accuracy reference voltage generator in a semiconductor integrated circuit, which can stably operate even at a low power supply voltage.

The present invention provides a circuit structure in which a predetermined reference voltage Vref can be obtained even at a power supply voltage lower than a conventional one.

DETAILED DESCRIPTION OF THE PREFERRED EMBODIMENTS

Hereinafter, embodiments of the present invention will be described with reference to the drawings.

Figure 1:
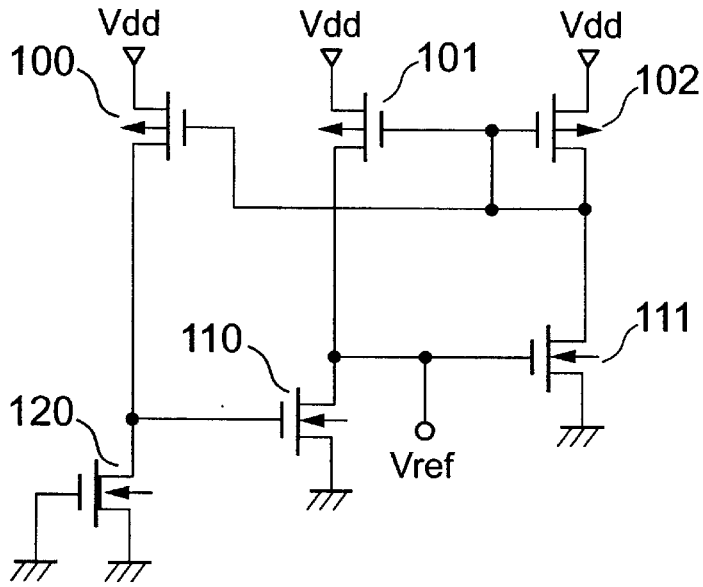
FIG. 1 is a circuit diagram of a reference voltage circuit of a first embodiment of the present invention.

FIG. 1 shows a reference voltage circuit of a first embodiment of the present invention. The circuit includes a constant current circuit of an n-channel depletion type MOS transistor 120 in which its source and gate are grounded, a grounded source amplifying circuit of an n-channel enhancement type MOS transistor 110 for outputting a reference voltage Vref, an n-channel enhancement type MOS transistor 111 having a gate to which the reference voltage Vref is connected, and a current mirror circuit constituted by p-channel enhancement type MOS transistors 100, 101 and 102 for generating and outputting a mirrored current out of a current inputted from the transistor 111.

Figure 3:
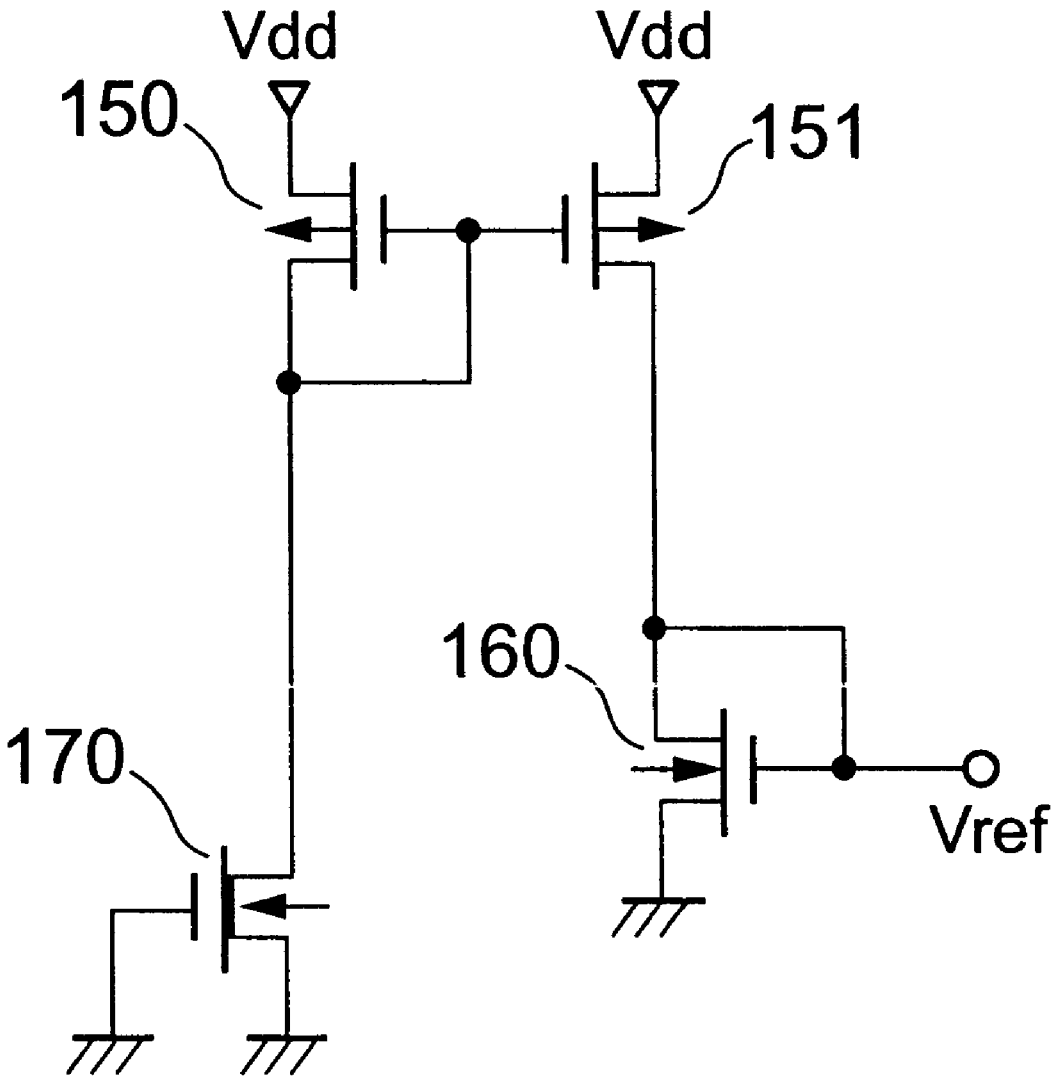
FIG. 3 PRIOR ART
FIG. 3 is a circuit diagram of a conventional reference voltage circuit.

A drain current ID(100) of the transistor 100 is equal to a drain current ID(120) of the constant current transistor 120. In the case where the sizes of the transistor 100 and 102 are equal to each other, since the transistors 100 and 102 form the current mirror circuit, the drain current ID(100) of the transistor 100 becomes equal to a drain current ID(102) of the transistor 102. Further, since a drain current ID(111) of the transistor 111 becomes equal to the drain current ID(102) of the transistor 102, eventually, the drain current ID(120) becomes equal to the drain current ID(111). Accordingly, similarly to the conventional circuit shown in FIG. 3, a gate-source voltage VGS(111) of the transistor 111 becomes the reference voltage Vref.

In order that the reference voltage Vref becomes a predetermined voltage, all the transistors must operate under a saturated state. When a minimum drain-source voltage at which the transistor 120 operates in the saturated state is made VDSAT(120) and the threshold value of the transistor 110 is made Vt(110), in order that the transistor 120 operates in the saturated state, the following relation has only to be satisfied:

$$VDSAT(\mathbf{120})<Vt(\mathbf{110}) \quad (4)$$

When the threshold value of the transistor 120 is made Vt(120), the minimum drain-source voltage VDSAT(120) at which the n-channel depletion type MOS transistor 120 operates in the saturated state is obtained by the following equation:

$$VDSAT(\mathbf{120})=Vt(\mathbf{120}) \quad (5)$$

Accordingly, from the equations (4) and (5), in order that the transistor 120 operates in the saturated state, the following relation has only to be satisfied:

$$Vt(\mathbf{120})<Vt(\mathbf{110}) \quad (6)$$

Normally, Vt(120) is set as approximately −0.4 V, and Vt(110) is set as approximately 0.6 V.

When a minimum drain-source voltage at which the transistor 100 operates in the saturated state is made VDSAT (100) and a gate-source voltage of the transistor 110 is made VGS(110), a minimum power source voltage Vdd(min) at which the reference voltage Vref becomes the predetermined voltage is obtained by the following equation:

$$Vdd(\text{min})=VDSAT(\mathbf{100})+VGS(\mathbf{110}) \quad (7)$$

Normally, since equations VDSAT(100)=0.2 V and VGS (110)=Vt(110)+0.4 V=0.6 V+0.4 V=1.0 V are roughly established, from the equation (7), Vdd(min) is obtained by the following equation:

$$Vdd(\text{min})=0.2\ \text{V}+1.0\ \text{V}=1.2\ \text{V},$$

and it is understood that the circuit operates at the power supply voltage lower than that of the conventional circuit.

In the first embodiment shown in FIG. 1, in the case where the power supply voltage is very slowly increased, there is a case where the reference voltage Vref is not outputted. In order to avoid such a defect, in a reference voltage circuit of a second embodiment, a starting circuit shown in FIG. 2 is added.

Figure 2:
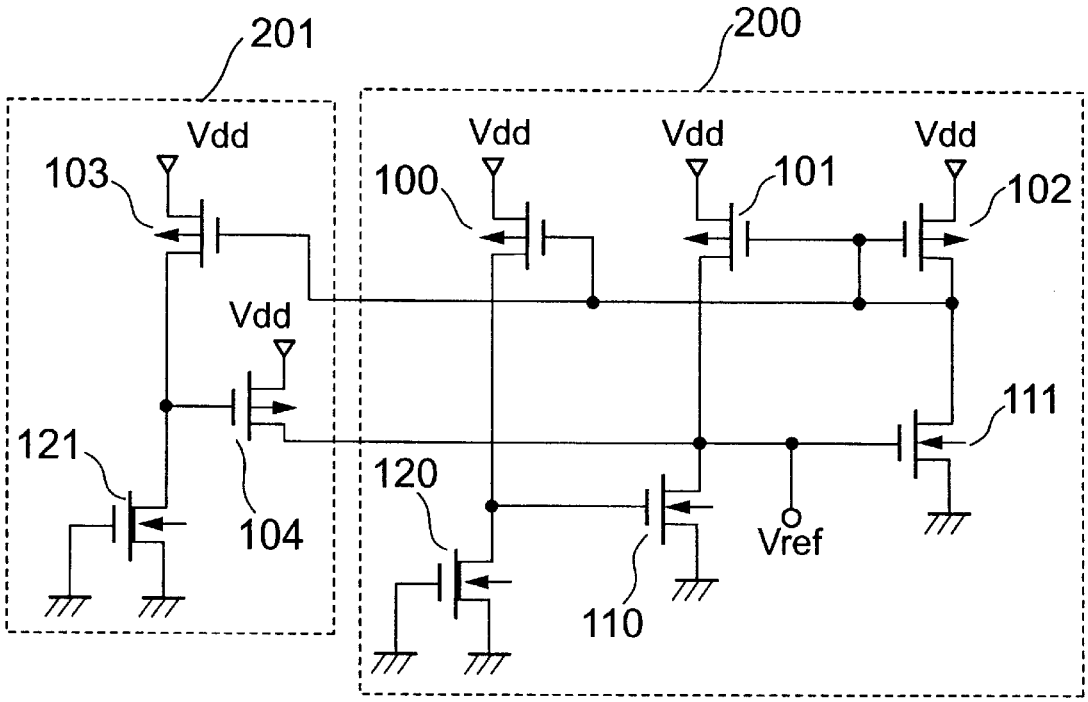
FIG. 2 is a circuit diagram of a reference voltage circuit of a second embodiment of the present invention.

The circuit shown in FIG. 2 is constituted by a reference voltage circuit which is explained in FIG. 1 and denoted by a reference numeral 200 here, and a starting circuit 201. The starting circuit 201 includes a constant current circuit of an n-channel depletion type MOS transistor 121 in which its source and gate are grounded, and p-channel enhancement type MOS transistors 103 and 104. The transistor 103 and the transistor 102 form a current mirror circuit.

Since a transistor 111 is in the OFF state immediately after the power supply is started, a drain current ID(102) of the transistor 102 is zero. Since the transistor 103 and the transistor 102 form the current mirror circuit, a drain current ID(103) of the transistor 103 is also zero.

On the other hand, since the transistor 121 is the constant current circuit, a gate voltage of the transistor 104 becomes zero. Accordingly, the transistor 104 becomes conductive to increase the gate voltage of the transistor 111, the transistor 111 becomes conductive, the reference voltage circuit 200 starts to operate, and the reference voltage Vref is outputted.

In the case where the transistors 102 and 103 are the same size, since the drain current of the transistor 111 becomes equal to the drain current of the transistor 103 by the current mirror circuit constituted by the transistors 102 and 103, when the transistor 111 is sufficiently conductive, the drain current of the transistor 103 is also increased. When the drain current of the transistor 103 exceeds the drain current of the transistor 121 of the constant current circuit, the gate voltage of the transistor 104 becomes equal to the power supply voltage Vdd, the transistor 104 is turned off, and the starting circuit 201 is cut off from the reference voltage circuit 200.

As described above, even in the case where the power source voltage is slowly increased, the reference voltage Vref can be certainly obtained.

The reference voltage circuit of the present invention can generate a high accuracy reference voltage, which stably operates even at a low power supply voltage, in a semiconductor integrated circuit.

What is claimed is:

1. A reference voltage generating circuit comprising: a constant current circuit comprising a first transistor which is a first conductivity type depletion type MOS transistor having a source and a gate that are grounded; a grounded source amplifying circuit comprising a second transistor which is a first conductivity type enhancement type MOS transistor connected to the first transistor; a third transistor which is a first conductivity type enhancement type MOS transistor having a gate which is connected to an output of the grounded source amplifying circuit; a fourth transistor which is a second conductivity type enhancement type MOS transistor for generating and outputting a mirrored current of a current output by the third transistor; a second constant current circuit comprised of a fifth transistor which is a first conductivity type depletion type MOS transistor having a source and a gate that are connected to the reference voltage generating circuit; and a sixth transistor which is a second conductivity type enhancement type MOS transistor connected to the fifth transistor so as to form a current circuit with the fourth transistor.

2. A reference voltage generating circuit comprising: a constant current circuit comprising a first conductivity type depletion type MOS transistor having a source and a gate that are grounded; an amplifying circuit comprising a first conductivity type enhancement type MOS transistor connected to the first conductivity type depletion type MOS transistor; a transistor having a gate connected to an output of the amplifying circuit; a current mirror circuit connected to an output of the transistor and comprising a second conductivity type enhancement type MOS transistor; a starter circuit comprising a second constant current circuit connected to the reference voltage generating circuit and another transistor connected to form a current circuit with the current mirror circuit.

3. A reference voltage generating circuit according to claim 2; wherein the second constant current circuit comprises a first conductivity type depletion type MOS transistor having a source and a gate that are connected to the reference voltage generating circuit.

4. A reference voltage generating circuit according to claim 2; wherein the other transistor comprises a second conductivity type enhancement type MOS transistor connected to the second constant current circuit.

5. A reference voltage generating circuit according to claim 2; wherein the transistor comprises a first conductivity type enhancement type MOS transistor.

6. A reference voltage generating circuit comprising: a constant current circuit; an amplifying circuit connected to the constant current circuit; a transistor having a gate connected to an output of the amplifying circuit; a current mirror circuit connected to an output of the transistor; a starter circuit comprising a second constant current circuit connected to the reference voltage circuit and another transistor connected to form a current circuit with the current mirror circuit.

7. A reference voltage generating circuit according to claim 6; wherein the second constant current circuit comprises a first conductivity type depletion type MOS transistor having a source and a gate that are connected to the reference voltage generating circuit.

8. A reference voltage generating circuit according to claim 7; wherein the other transistor comprises a second conductivity type enhancement type MOS transistor connected to the second constant current circuit.

* * * * *